US008671478B2

(12) United States Patent
Rippe et al.

(10) Patent No.: US 8,671,478 B2
(45) Date of Patent: Mar. 18, 2014

(54) MATTRESS AND BED DECK COVER

(75) Inventors: Bruce M. Rippe, Batesville, IN (US); Catherine Marie Wagner, Osgood, IN (US); Douglas E. Borgman, Brookville, IN (US); Bernard F. Voegele, Batesville, IN (US); David John Ulrich, Sunman, IN (US)

(73) Assignee: Trinity Guardion, LLC, Batesville, IN (US)

( * ) Notice: Subject to any disclaimer, the term of this patent is extended or adjusted under 35 U.S.C. 154(b) by 244 days.

(21) Appl. No.: 12/930,687

(22) Filed: Jan. 13, 2011

(65) Prior Publication Data

US 2011/0138533 A1 Jun. 16, 2011

Related U.S. Application Data

(63) Continuation-in-part of application No. 12/804,059, filed on Jul. 13, 2010.

(60) Provisional application No. 61/270,739, filed on Jul. 13, 2009.

(51) Int. Cl.
*A47C 21/02* (2006.01)

(52) U.S. Cl.
USPC ..... 5/498; 5/496; 5/497; 5/499; 24/72.5

(58) Field of Classification Search
USPC ..... 5/495–499; 24/72.5
See application file for complete search history.

(56) References Cited

U.S. PATENT DOCUMENTS

| | | | | |
|---|---|---|---|---|
| 1,137,220 | A | 4/1915 | Lehmann | |
| 2,103,244 | A * | 12/1937 | Briscoe | 24/72.5 |
| 2,791,784 | A | 5/1957 | Tomsic | |
| 4,336,621 | A * | 6/1982 | Schwartz et al. | 5/658 |
| 5,911,654 | A | 6/1999 | Webb | |
| 6,185,766 | B1 | 2/2001 | Farrugia | |
| 6,631,529 | B1 | 10/2003 | Erickson | |
| 7,093,310 | B2 * | 8/2006 | Barros | 5/482 |
| 7,120,952 | B1 | 10/2006 | Bass et al. | |
| 7,222,377 | B2 | 5/2007 | Kramer et al. | |
| 7,325,263 | B2 | 2/2008 | Stribling | |

(Continued)

FOREIGN PATENT DOCUMENTS

| | | |
|---|---|---|
| EP | 1316635 A2 | 4/2003 |
| FR | 1112549 | 3/1956 |
| GB | 1193872 | 6/1970 |

OTHER PUBLICATIONS

International Search Report, Form PCT/ISA/210, 2 pages, for International Application No. PCT/US11/00058 completed on Mar. 3, 2011 and mailed Mar. 25, 2011.

(Continued)

*Primary Examiner* — Nicholas Polito
(74) *Attorney, Agent, or Firm* — Bingham Greenebaum Doll LLP; James C. Eaves, Jr.; Brian W. Chellgren

(57) ABSTRACT

The present invention relates to a cover for a mattress and bed deck. More particularly, the present invention relates to a mattress and bed deck cover for an adjustable bed that reduces the exposure of the mattress and bed deck to unsanitary conditions.

19 Claims, 8 Drawing Sheets

(56) References Cited

U.S. PATENT DOCUMENTS

| | | | | |
|---|---|---|---|---|
| 7,353,550 | B2 | 4/2008 | Antinori | |
| 7,754,625 | B2 * | 7/2010 | Hendriks et al. | 442/123 |
| 2007/0151028 | A1 | 7/2007 | Bauer | |
| 2007/0189932 | A1 | 8/2007 | Glenn et al. | |
| 2007/0199155 | A1 | 8/2007 | Thygsen | |
| 2009/0056030 | A1 | 3/2009 | Bolden | |
| 2009/0064415 | A1 | 3/2009 | Payne et al. | |
| 2010/0281613 | A1 | 11/2010 | Hillenbrand, II | |

OTHER PUBLICATIONS

European Search Opinion for Application No. EP 10800152.0.

Supplementary European Search Report for Application No. EP 10800152.0.

International Search Report, Form PCT/ISA/210, 3 pages, for International Application No. PCT/US10/01958 completed on Aug. 20, 2010 and mailed Sep. 1, 2010.

* cited by examiner

MATTRESS AND BED DECK COVER

This application is a continuation-in-part of U.S. patent application Ser. No. 12/804,059, entitled MATTRESS AND BED DECK COVER, to Bruce M. Rippe, David J. Ulrich, Catherine M. Wagner, Douglas E. Borgman, and Bernard F. Voegele, filed Jul. 13, 2010, which claimed the benefit of U.S. Provisional Patent Application Ser. No. 61/270,739, entitled MATTRESS AND BED DECK COVER, to Bruce M. Rippe, David J. Ulrich, Catherine M. Wagner, Douglas E. Borgman, and Bernard F. Voegele, filed Jul. 13, 2009, both incorporated herein by reference.

BACKGROUND OF THE INVENTION (a) Field of the Invention

The present invention relates to a cover for a mattress and bed deck. More particularly, the present invention relates to a mattress and bed deck cover for an adjustable bed that reduces the exposure of the mattress and bed deck to unsanitary conditions.

(b) Description of the Prior Art

Mattress covers are commonly used to protect mattresses from staining, soiling, or other results of contact with unsanitary conditions. The need for effective mattress covers is greater in a healthcare setting, where contact with large scale contaminants, such as blood or waste products, and small scale contaminants, such as bacteria or fungi, is a daily occurrence. Mattress covers must be cleaned on a regular basis to maintain a sanitary environment.

Mattresses are supported by bed decks. Bed decks may come into contact with the same unsanitary conditions as mattresses and mattress covers. For example, waste produced by a patient may flow off the mattress or mattress cover and accumulate on the supporting bed deck. Under current techniques, the cumbersome mattress must be manually raised from the bed deck, the bed deck cleaned by hand using a germicidal solution, and the mattress replaced atop the bed deck. However, hospital workers may neglect to clean the bed deck, or may not fully clean the entire surface of the bed deck. Alternatively, a worker may insufficiently clean a mattress then transfer contaminants from the mattress when he moves on to clean the bed deck. Furthermore, manual cleaning may not be sufficient to eliminate bacteria embedded in the bed deck or kill fungal spores. Any contamination on the bed deck may be passed to clean mattress covers or bed sheets, from which the contaminants may contact a patient.

A need exists for a removable cover that protects both mattresses and bed decks from unsanitary conditions and is capable of being laundered. This need is complicated in a healthcare environment, where mattresses and bed decks are incorporated into adjustable beds. Adjustable beds used in healthcare settings include bed decks and mattress which can be raised, lowered, and articulated into various configurations. A need exists for a removable cover for the mattress and bed deck of an adjustable bed that is capable of protecting and remaining attached to the mattress and bed deck while the adjustable bed adopts different configurations.

SUMMARY OF THE INVENTION

The aforementioned problems have been solved in the present invention, which provides a mattress and bed deck cover. More particularly, the present invention relates to a mattress and bed deck cover for an adjustable bed that reduces the exposure of the mattress and bed deck to unsanitary conditions.

Conventional bedding utilizes a fitted sheet that encapsulates the top and sides of a mattress, and a flat sheet and one or more blankets that are tucked into the space between the mattress and the supporting bed deck or box spring. One difficulty with using a single cover to protect both the mattress and the bed deck is that access to the space between the mattress and bed deck would be lost and bedding material could not be tucked into that space. The present invention solves this problem by including a channel at the foot end of the cover, whereby a flat sheet and blankets may be tucked between the mattress and bed deck. In some embodiments, the present invention may also include a channel at the head end of the cover, whereby a fitted sheet may be wrapped around both the head end and foot end of the mattress. In some embodiments, the present invention may also include at least one flap extending from the cover and used to cover specific features of the bed deck.

Adjustable beds, as used in hospitals and other healthcare settings, can be raised, lowered, and adjusted into various configurations. The present invention is capable of remaining in position on the mattress and bed deck while the adjustable bed adopts different configurations. While the bed is positioned horizontally, the mattress and bed deck cover fits tautly over the bed. A taut cover eliminates folds and gathers in which waste may accumulate and which may cause pressure ulcers.

Adjustable beds, as used in hospitals and other healthcare settings, may incorporate devices, controls, and fittings such as, for example, controls to raise or lower parts of the bed or fittings for I.V. poles to be removably attached to the bed. Access to these devices, controls, and fittings cannot be restricted by the mattress and bed deck cover. The present inventions solves this problem by providing a sufficient number of apertures to grant access to devices incorporated into the bed deck, while still protecting the bed deck from contamination and remaining securely attached to the mattress and bed deck. Apertures may also be included to allow the mattress and bed deck cover to fit around bed rails, handles, other structural features of adjustable beds.

Certain inorganic agents, such as metal ions, are known to have antimicrobial and antifungal activity. Silver is known as a broad spectrum antibiotic with minimal health concerns. Copper is known to have antifungal activity and a synergistic effect with silver against bacteria. Zinc has weak antimicrobial activity and the ability to moderate the release of silver from a carrier. While there is a low frequency of bacteria developing resistance to silver, exposure to sub-lethal concentrations of silver may increase the chance of resistance development.

The present invention combines the antimicrobial and antifungal properties of metal ions with the need for more hygienic surfaces in bedding. In this embodiment, the present invention relates to the incorporation of metal ions into a film coating applied to a mattress and bed deck cover. More particularly, the present invention relates to a mattress and bed deck cover coated with a film coating material incorporating soluble glass carriers containing silver. A particular advantage of this embodiment of the present invention over surface treatment of bedding material with antimicrobial agents is that metal ions are not released into the environment, but kill by directly contacting the microbes or fungi. By providing a substantially nonleaching film coating, metal ions are not released into the environment, reducing the risk of bacteria developing resistance due to exposure of sub-lethal concentrations of metal ions. Thus the present invention provides the antimicrobial effectiveness of metal ions while minimizing the chances of creating bacterial strains resistant to the antimicrobial activity of metal ions. Another particular advantage of this embodiment is that incorporation of antimicrobial and antifungal properties into the present invention reduces odors.

The mattress and bed deck cover is designed to be laundered using U.S. Center for Disease Control-approved healthcare laundering techniques, e.g., washing with detergent in water at a temperature greater or equal to 160° F. (71° C.) for at least 25 minutes. Quality conventional mattress covers for hospital use are manufactured using fabric welds to prevent fluids from wicking through the cover to the mattress. However, standard fabric welds tend to break during repeated laundering cycles. In addition, standard healthcare laundering techniques may not be sufficiently intense to eliminate bacteria embedded in a conventional mattress cover. In the present invention high strength welds are used which are capable of withstanding the agitation and high temperature of the laundering process. Furthermore, the antimicrobial film coating of the cover kills bacteria and prevents them from becoming embedded in the cover. Therefore, a standard healthcare laundering process is sufficiently intense to decontaminate the present invention, whereas it may not be sufficient to decontaminate a cover without such a film coating.

In one embodiment, the present invention is a mattress and bed deck cover comprising a top surface, a head end descending from the top surface, a foot end descending from the top surface and opposing the head end, a pair of opposing sides descending from the top surface and substantially perpendicular to the head end and the foot end and connected thereto, means for removably fixing the cover in relation to a mattress and a bed deck, and a foot end channel extending the width of the foot end and a portion of the length of the sides, wherein the cover is sized to enclose the mattress and at least a portion of the bed deck, with the foot end channel oriented to interpose a portion of the mattress and the bed deck.

BRIEF DESCRIPTION OF THE DRAWINGS

A better understanding of the present invention will be had upon reference to the following description in conjunction with the accompanying drawing, wherein.

DETAILED DESCRIPTION OF THE PREFERRED EMBODIMENT

Figure 1:
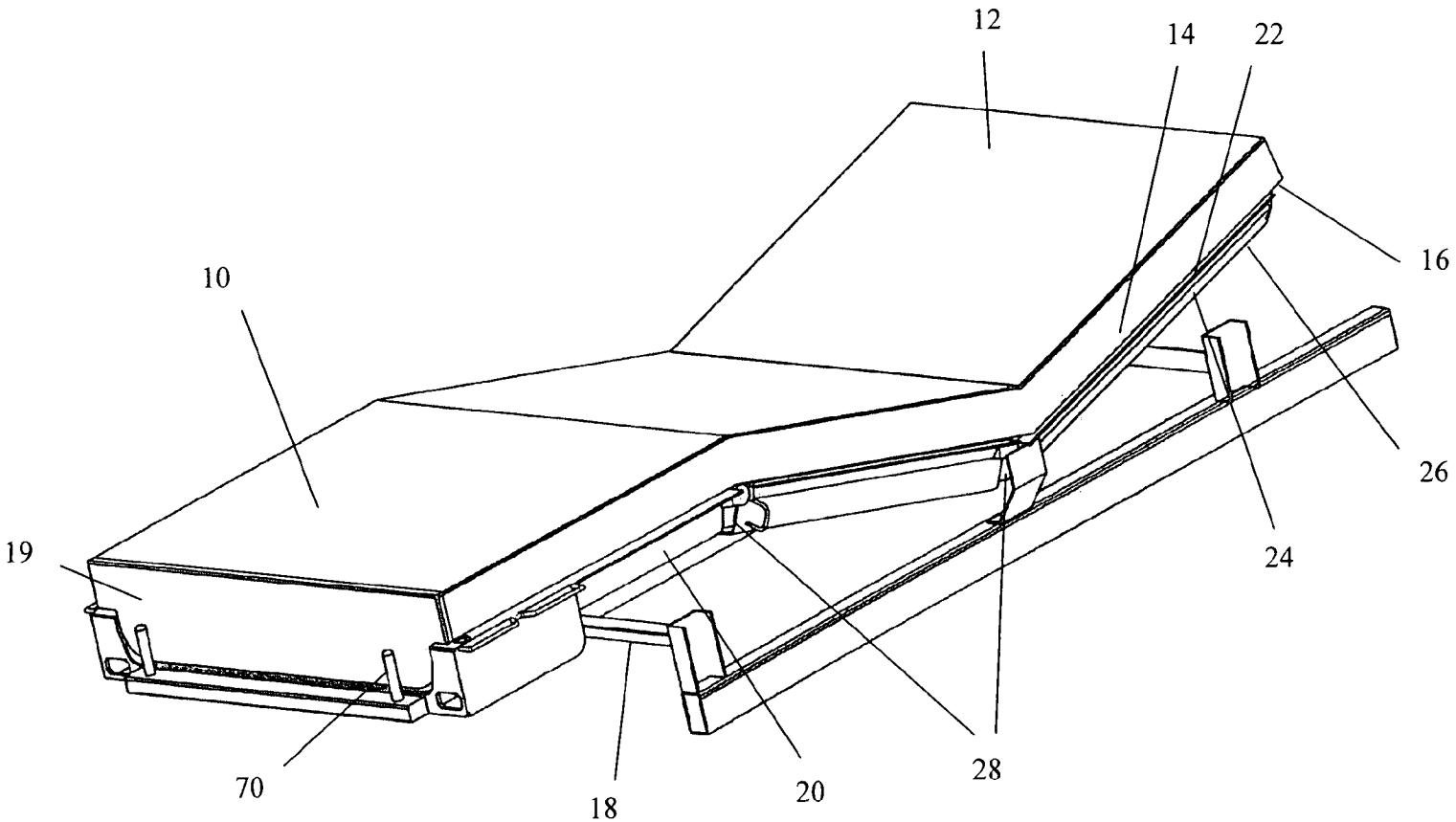
FIG. 1 depicts a foot end perspective view of an adjustable bed and a mattress.

As shown in FIG. 1, a mattress 10 includes a mattress top 12, mattress sides 14, and mattress bottom 16. An adjustable bed 18 incorporates a bed deck 20 which supports and underlies the mattress 10. The bed deck 20 includes a bed deck top 22, bed deck sides 24, and bed deck bottom 26. The bed deck 20 also includes at least one pivot point 28 about which the bed deck 20 and mattress 10 may be articulated.

Figures 2A, 2B, 2C, 2D:
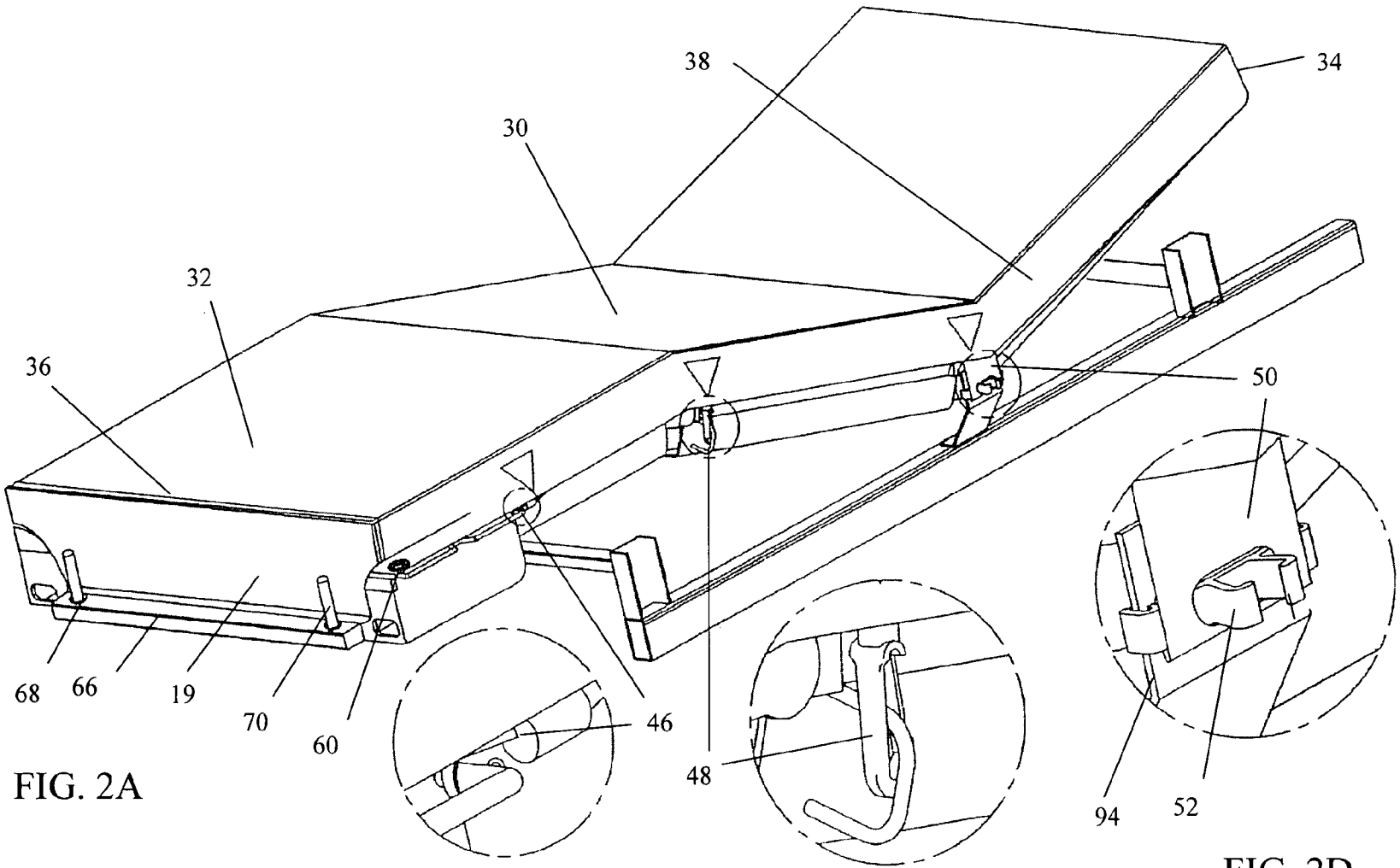
FIG. 2A depicts a foot end perspective view of an adjustable bed and a first embodiment of a mattress and bed deck cover.
FIG. 2B depicts a detail view of FIG. 2A, focusing on a hook.
FIG. 2C depicts a detail view of FIG. 2A, focusing on a loop.
FIG. 2D depicts a detail view of FIG. 2A, focusing on a clip.
Figures 3A, 3B, 3C:
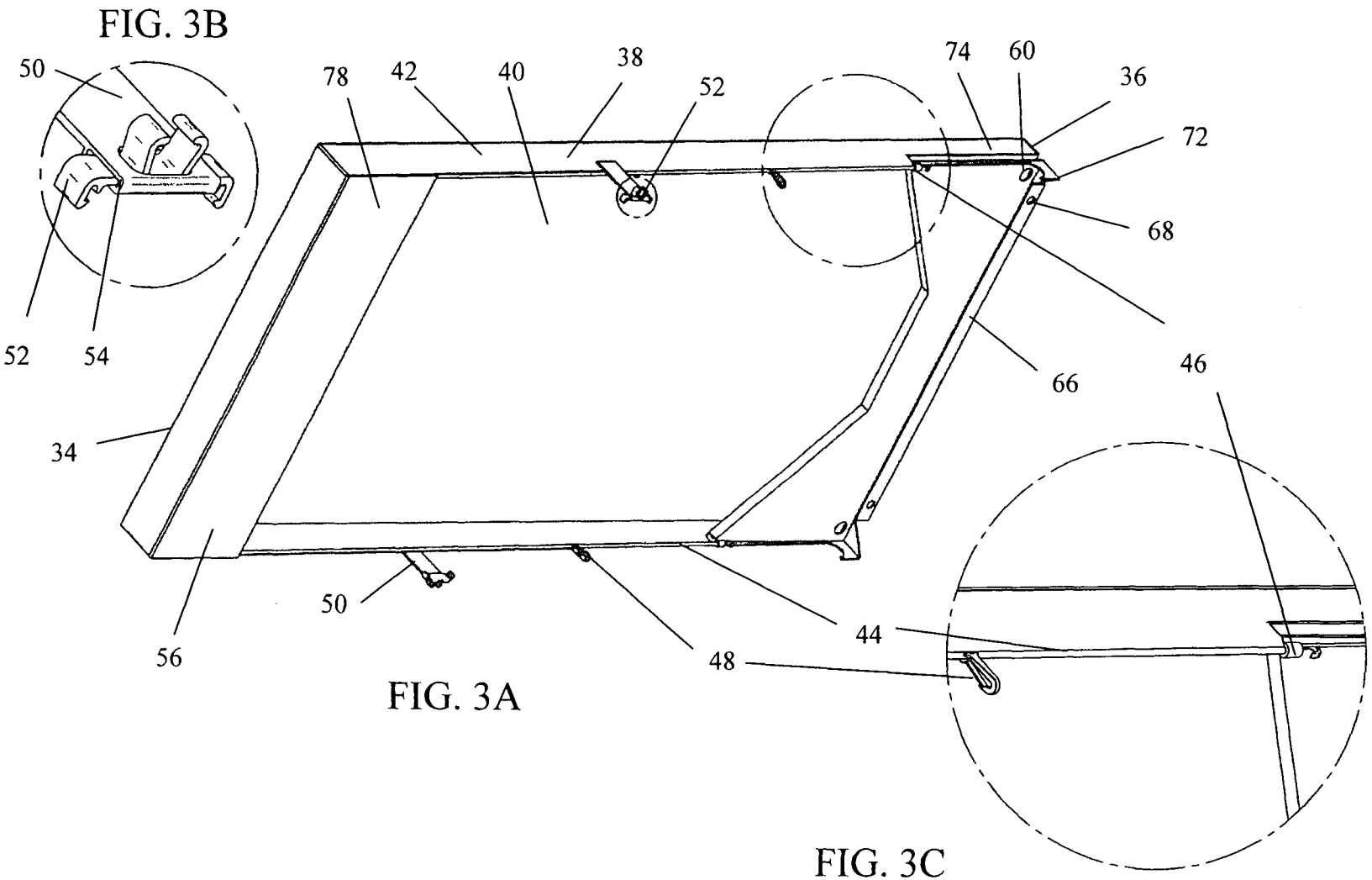
FIG. 3A depicts a bottom perspective view of the first embodiment of a mattress and bed deck cover.
FIG. 3B depicts a detail view of FIG. 3A, focusing on the clip.
FIG. 3C depicts a detail view of FIG. 3A, focusing on the loop and the hook.
Figure 4:
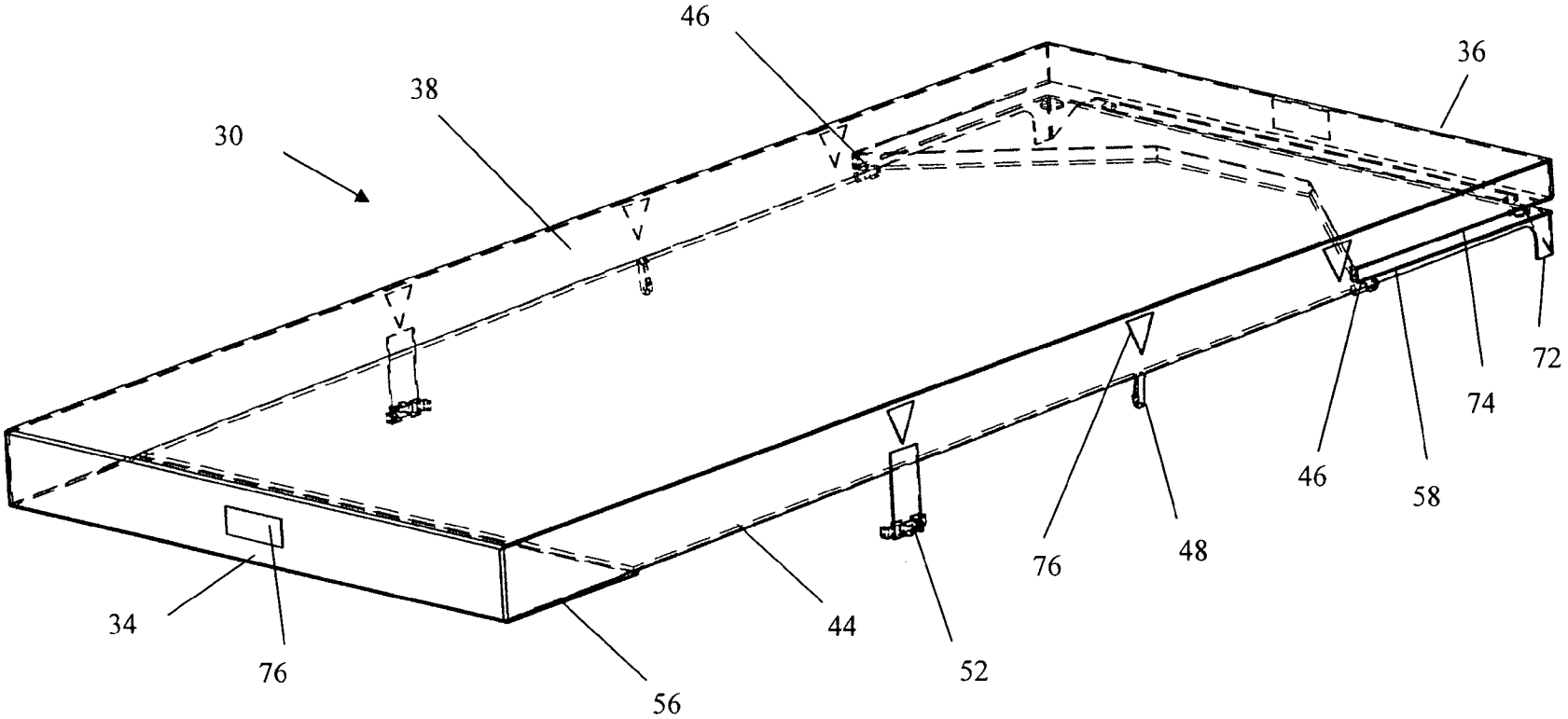
FIG. 4 depicts a hidden line head end perspective view of the first embodiment of a mattress and bed deck cover.

FIGS. 2-4 depict a first embodiment of a mattress and bed deck cover. As shown in FIG. 2A, the mattress and bed deck cover 30 includes a top surface 32, a head end 34 descending from the top surface 32, a foot end 36 descending from the top surface 32 and opposing the head end 34, and a pair of opposing sides 38 descending from the top surface 32 and substantially perpendicular to the head end 34 and the foot end 36 and connected thereto. The cover 30 may enclose at least the mattress top 12, mattress sides 14, and at least a portion of the mattress bottom 16, and at least a portion of the bed deck top 22 and bed deck sides 24. A person lying on the cover 30, mattress 10, and bed deck 20 preferably orients his or her head towards the head end 34 and his or her feet towards the foot end 36.

Referring now to FIGS. 1 and 2A, the cover 30 of the first embodiment is designed to be installed on a bed 18 which includes a removable foot board 19. This foot board 19 abuts the foot end 36 of the mattress 10, and must be removed each time the cover 30 is installed or removed from the mattress 10 and bed deck 20.

The mattress and bed deck cover 30 is preferably constructed of a liquid-impermeable fabric with a film coating. In a preferred embodiment, the fabric is a multi-directional stretch polyester fabric with welded or sealed seams and corners. In this embodiment, the mattress and bed deck cover 30 is suitable for disinfection using healthcare laundering techniques. As shown in FIG. 3A, the mattress and bed deck cover 30 includes an inner surface 40, which contacts the mattress 10 and bed deck 20, and an outer surface 42, which is exposed to the environment. In a preferred embodiment, the film coating is polyurethane and is only present on the outer surface 42. The film coating preferably incorporates an agent with antimicrobial and/or antifungal properties such as, for example, antimicrobial metal. In a preferred embodiment, the film coating contains borophosphosilicate glass carriers containing silver ions. In this preferred embodiment, the film coating provides the cover 30 with a substantially nonleaching antimicrobial film coating.

The mattress and bed deck cover 30 includes means for removably fixing the cover 30 in relation to the mattress 10 and bed deck 20. In one embodiment, the means for removably fixing the cover 30 includes at least one elastic band 44. In the first embodiment depicted in FIGS. 2-4, the mattress and bed deck cover 30 includes an elastic band 44 that draws the mattress and bed deck cover 30 under the bed deck 20 for retention. In this embodiment, the elastic band 44 is sewn or welded into the lower edge of the sides 38 and the lip of the head end pocket 56, forming a U-shape, with a hook 46 attached to either end of the elastic band 44. These hooks 46 may be used to secure the cover 30 to fittings on the bed deck 20, as shown in FIG. 2B.

In this first embodiment, the means for removably fixing the cover 30 also includes a plurality of loops 48, each with a sprung gate, commonly referred to as "carabiners." These loops 48 are affixed to the lower edge of the sides 38, and may be used to secure the cover to the fittings on the bed deck 20, as shown in FIG. 2C. Preferably, each of the plurality of loops 48 are constructed from plastic.

In this embodiment, the means for removably fixing the cover 30 also includes a plurality of straps 50. Each strap 50 descends from the one of the sides 38 of the cover 30. Each of the plurality of straps 50 includes a clip 52 to removably secure the cover 30 to the bed deck 20, as shown in FIG. 2D. The clip 52 is positioned within a strap channel 54, as shown in FIG. 3B, and is described in more detail below.

In other embodiments, the mattress and bed deck cover 30 may employ fasteners, zippers, buttons, clips, magnets, hook and loop attachments or other suitable means or combination of means for removably fixing the mattress and bed deck cover 30 in relation to the mattress 10 and bed deck 20.

As shown in FIGS. 3A and 4, the mattress and bed deck cover 30 includes a head end pocket 56 located at the head end 34 of the cover 30 and extending the width of the cover 30 and a portion of the length of the sides 38. The head end pocket 56 is defined by the top surface 32, sides 38, head end 34, and a head end panel 78 extending the width of the head end 34 and a portion of the length of the sides 38. The head end panel 78 is substantially perpendicular to the sides 38 and head end 34, and is connected thereto, and is substantially parallel to the top surface 32. The head end pocket 56 is sized to receive at least one of the head end of the mattress 10 and the head end of the bed deck 20. In this first embodiment, the head end pocket 56 is sized to receive a portion of both the mattress 10 and the bed deck 20

The mattress and bed deck cover 30 includes a foot end channel 58 located at the foot end 36 of the cover 30 and extending the width of the foot end 36 and a portion of the length of the sides 38. The foot end channel 58 permits a fitted sheet to wrap around the foot end corners of the mattress 10 and permits flat sheets and blankets to be tucked between the mattress 10 and bed deck 20, while still limiting contact between contaminants and the mattress 10 and bed deck 20. As shown in FIGS. 3A and 4, the foot end channel 58 in this embodiment has a greater length near the sides 38 of the cover 30, which decreases at an angle, and remains constant near the center of the cover 30. In other embodiments, the foot end channel 58 may have a constant length across its width, or may otherwise be adapted to correspond to the top 22 and sides 24 of the bed deck 28.

In this first embodiment, the cover 30 includes a foot end mattress pocket 74 defined by the top surface 32, sides 38, foot end 36, and upper surface of the foot end channel 58. The foot end pocket is sized to receive the foot end of the mattress 10.

The adjustable bed 18 may include at least one device, control, or fitting, such as, for example a bed rail, a fitting for an I.V. holder, a trapeze adapter, or a control for the bed 18. Referring now to FIGS. 1 and 2A, one style of adjustable bed 18 includes at least one fitting, in this case, one located near each of the corners of the bed deck 20 adjacent to the foot end 34. These two fittings are configured to each accept the vertical pole of an I.V. holder. To allow these poles to pass through the cover 30, the first embodiment of a mattress and bed deck cover 30 includes at least one cover aperture 60. More specifically, the cover 30 includes a cover aperture 60 in proximity to each of the corners of the lower surface of the foot end channel 58, and arranged to allow a pole to pass serially through the cover aperture 60 and a fitting in the bed deck 20. Each cover aperture 60 is adapted to surround a pole, providing a channel through the cover 30, while maintaining coverage of the bed deck 20 and retention of the mattress and bed deck cover 30 on the mattress 10 and bed deck 20. In other embodiments, the adjustable 18 bed may include zero, one, or a plurality of fittings which require access through the cover 30. In these embodiments, the mattress and bed deck cover 30 includes one cover aperture 60 per fitting, properly sized to snugly accept the pole or other object to be passed through the cover 30.

The cover 30 includes a tab 66 extending lengthwise from the lower surface of the foot end channel 58. The tab 66 includes at least one tab aperture 68. This first embodiment of the present invention is designed to be installed on a bed deck 20 including at least one bed deck guide 70, as shown in FIGS. 1 and 2A. In this embodiment, the cover 30 includes one tab aperture 68 per bed deck guide 70, the tab aperture 68 being sized to accept the bed deck guide 70. Upon installation of the cover 30, the foot board 19 is removed, the tab 66 is extended beneath the customary position of the foot board 19 and positioned such that a bed deck guide 70 extends through each tab aperture 68, and the foot board 19 is replaced atop the tab 66. Extending each bed deck guide 70 through a tab aperture 68 mechanically secures the cover 30 to the bed deck 20. FIG. 2A depicts the installed cover 30 wherein the tab 66 extends beneath the foot board 19 and the bed deck guides 70 are retained each within a tab aperture 68.

In this first embodiment, the cover 30 includes a pair of flaps 72 descending from each foot end 36 corner. Each flap extends along a portion of a side 38 and a portion of the foot end 36 of the cover. These flaps 72 are configured to cover the corners of the bed deck 20 adjacent the foot end 36. In other embodiments, the cover may include zero, one, at least one, or a plurality of flaps 72 descending from the sides 38, head end 34, or foot end 36 of the cover 30, or extending from other locations on the cover 30, as necessary to cover specific features on the bed deck 20 or bed 18.

The mattress and bed deck cover 30 may include at least one orientation marker 76 to assist users in properly installing the cover 30 on an adjustable bed 18. At least one marker 76 may be used to identify the head end 34 and foot end 36 of the cover 30, identify the locations of means for removably fixing the cover 30 in relation to the mattress 10 and bed deck 20, or otherwise provide guidance to users regarding the proper installation of the cover 30.

In the first embodiment, the bed deck 20 is 33.5 inches (85.1 cm) inches wide by 85.0 inches (215.9 cm) long. In this embodiment, the mattress 10 is sized about 35.0 inches (88.9 cm) wide by 85.5 inches (217.2 cm) long. The mattress 10 is about 2.125 inches (5.40 cm) high. In this embodiment, the mattress and bed deck cover 30 is sized to snugly fit the mattress 10 and bed deck 20. The mattress and bed deck cover 30 is about 85.5 inches (217.2 cm) long, 35.0 inches (88.9 cm) wide and about 4.125 inches (10.48 cm) high. In a preferred embodiment, the cover 30 is manufactured from a multi-directional stretch polyester fabric capable of stretching at least several inches in each direction.

In this embodiment, the head end pocket 56 extends from the head end 34 of the cover 30 with a length of about 10.125 inches (25.72 cm). The foot end channel 58 has a length of about 16.0 inches (40.6 cm) adjacent the side 38 of the cover 30. The length decreases to about 5.163 inches (13.11 cm) as the channel extends 12.0 inches (30.5 cm) from the side 38, remains constant at 5.163 inches (13.11 cm) for a width of 11.0 inches (27.9 cm), then increases back to a length of about 16.0 inches (40.6 cm) as the channel 58 extends 12.0 inches (30.5 cm) to the opposing side 38 of the cover 30. The foot end channel 58 is located on the foot end 36 of the cover at a height of about 2.125 inches (5.40 cm) from the top surface 32 of the cover 30. The foot end channel 58 extends the full width of the cover 30. The foot end pocket 74 is located above the foot end channel 58 and corresponds to the shape of the foot end channel 58. The tab 66 is centered width-wise on the foot end 36, and extends lengthwise from the foot end 36. The tab 66 is about 26.625 inches (67.63 cm) wide and about 2.0 inches in length (5.0 cm). The at least one tab aperture 68 is two apertures, each positioned to accept a bed guide 70 when the cover 30 is installed on the bed 18. Each of the pair of flaps 72 descends about 2.0 inches (5.0 cm) from the lower surface of the foot end channel 58 and extends about 1.75 inches (4.45 cm) along an opposing side 38 of the cover 30 and about 1.5 inches (3.8 cm) along the foot end 36 of the cover 30. The height of the cover 30 at the foot end 36, including the foot end pocket 74 and the flaps 72, is about 4.125 inches (10.48 cm) high.

Each strap 50 descends about 4.0 inches (10.2 cm) below the edge of each side 38 and is about 2.875 inches (7.30 cm) in length. As shown in FIG. 3B, each strap 50 includes a strap channel 54 sized to snugly fit the clip 52. Each strap also includes a strap aperture 54, through which a portion of the clip 52 extends. In this embodiment, as indicated in FIGS. 3A, 3C and 4, a strap 50 descends from each of the sides 38 and is located about 30.375 inches (77.15 cm) from the head end 34. A loop 48 descends from each of the sides 38 and is located about 48.625 inches (123.5 cm) from the head end 34. Hook 46 are attached to each end of the elastic band 44, and are secured to the lower edge of each side 38 at a position about 63.625 inches (161.6 cm) from the head end 34. In other embodiments, the positions of each element of the means for removably fixing the cover 30 to the mattress 10 and bed deck 20 may be modified to fit the particular mattress 10 and bed deck 20 of interest.

This first embodiment describes a mattress and deck cover. 30 sized to fit a particular mattress used in the healthcare industry. In other embodiments, the mattress and bed deck cover 30 may be sized to fit crib, twin/single, full/double, queen, king, or non-standard sized mattresses.

Figure 5B:
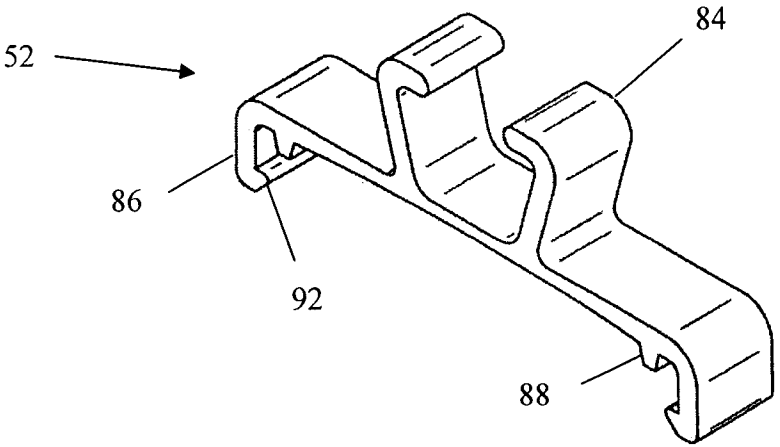
FIG. 5B depicts a perspective view of the clip.
Figure 5A:
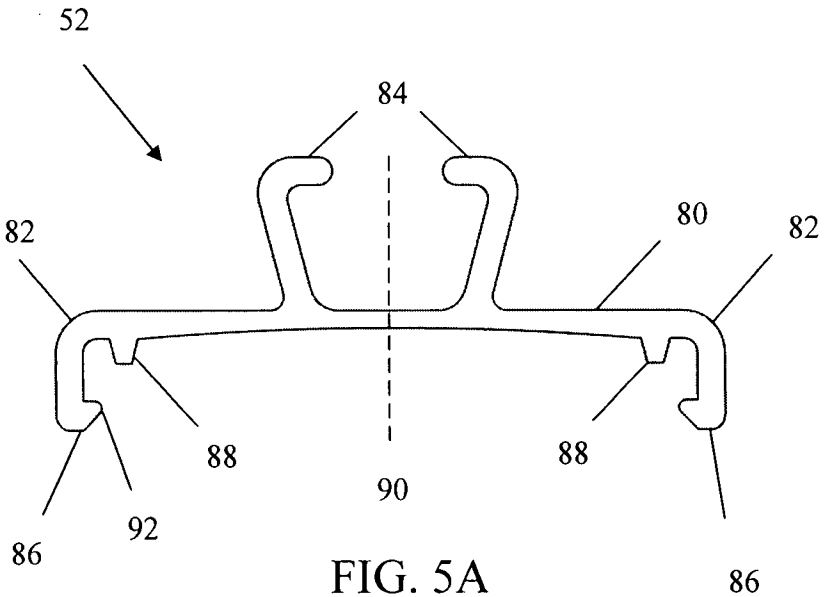
FIG. 5A depicts a front view of the clip.

As shown in FIGS. 5A-5B, the clip 52 comprises a generally rectangular body 80 having opposing rounded ends 82. The body 80 includes a pair of ascending opposing arms 84 and a pair of opposing legs 86, each leg 86 descending from a rounded end 82.

The clip 52 includes a center line 90, about which the clip is laterally symmetrical. The opposing arms 84 extend generally upwards from the body 80 at an angle, then curve in the direction of the center line 90. The body 80 also includes a pair of descending juts 88, each jut 88 associated with and located in proximity to one of the legs 86. Each leg 86 includes a nub 92 extending therefrom in the direction of the center line 90. As shown in FIG. 2D, the clip 52 is configured to snap fit onto a generally rectangular structural element 94 of the bed 18, contacting one side of the element 94 with the juts 88, contacting the opposite side of the part with the nubs 92, and contacting the sides of the element 94 with the legs 86. When the clip 52 is attached to the bed 18, the arms 84 extend outwards from the bed 18. A user may squeeze the arms 84 together, thereby causing the body 80 to bend about the center line 90 and release the legs 86 from the structural element 94.

In one embodiment, the clip 52 is about 3.03 inches (7.70 cm) inches in length, 0.5 inches (1.27 cm) in width, and 1.20 inches (3.06 cm) in height. The body 80 has a height of about 0.075 inches (1.9 mm). The rounded ends 82 are segments of a circle with a radius of 0.19 inches (4.8 mm). Each arm 84 extends generally upwards at a point about 1.124 inches (2.855 cm) from its nearest end 82 at an angle of 75 degrees from the body 80 to a height of about 1.016 inches (2.58 cm), then curves in the direction of the center line 90. The gap between the opposing faces of the arms 84 is about 0.5 inches (1.27 cm). The top surface of the body 80 is substantially flat. The bottom surface of the body 80 is slightly curved, with the narrowest portion located at the center line 90 and having a height of 0.075 inches (1.91 mm). The bottom surface of the body is a segment of a circle having a radius of 12.977 inches (32.96 cm). Each jut 88 is located about 0.3125 inches (7.94 mm) from its nearest end 82 and is generally trapezoidal in shape. Each jut 88 is about 0.131 inches (3.33 mm) wide at the body 80 and narrows to about 0.073 inches (1.85 mm) wide. Each leg 86 extends downward 0.522 inches (13.26 mm) as measured from the top surface of the body 80, and is about 0.125 inches (3.18 mm) long. Each leg 86 includes a generally triangular nub 92 with a rounded corner which extends in the direction of the center line 90. The horizontal faces of the nubs 92, as shown in FIG. 5C, oppose the bottom surfaces of the juts 88. The height of each nub 92 is about 0.127 inches (3.23 mm) and the greatest width of each nub 92, not including the width of the arm 86, is about 0.084 inches (2.13 mm). The horizontal faces of the nubs 92 are separated from the bottom surfaces of the juts 88 by a height of about 0.162 inches (4.11 mm).

Figure 6:
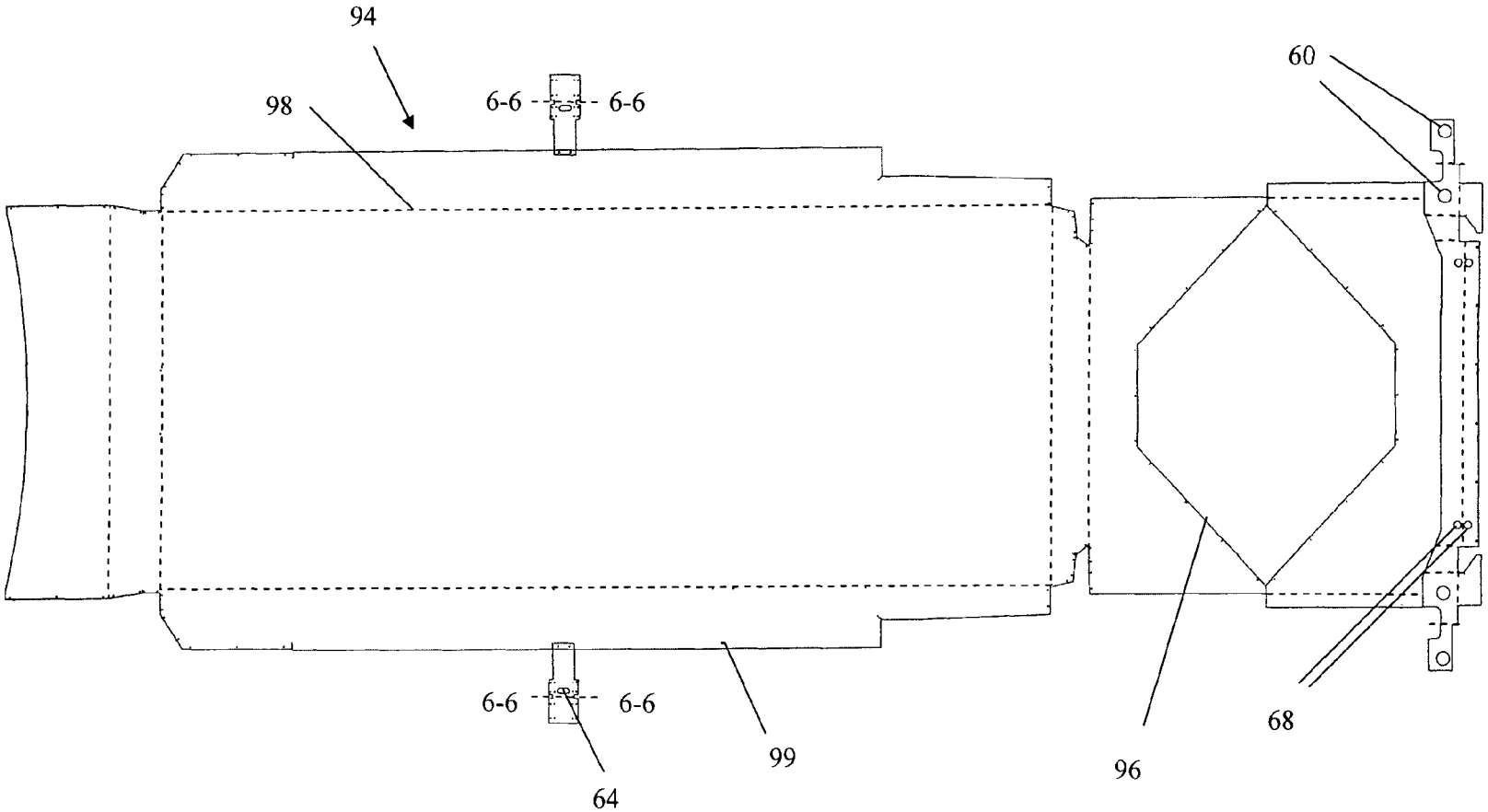
FIG. 6 depicts a pattern layout for the first embodiment of a mattress and bed deck cover.

FIG. 6 depicts a pattern layout 94 of the first embodiment of a mattress and bed deck cover 30. Cut lines 96 in the fabric are indicated by solid lines. Fold lines 98 are indicated by dashed lines. A plurality of marker holes 99 are used to place the fabric on locator pins when individual panels are sewn or welded together. These marker holes 99 are preferably located in the seam allowance of the cover 30. In this first embodiment, a clip 52 is secured to each strap 50 by inserting the arms 84 of the clip 52 into the strap aperture 64, folding the fabric along fold line 6-6 onto itself to partially surround the body 80 of the clip 52, and sewing or welding the layers of fabric together to form the strap channel 54 that retains the clip 52.

Figures 7A, 7B, 7C:
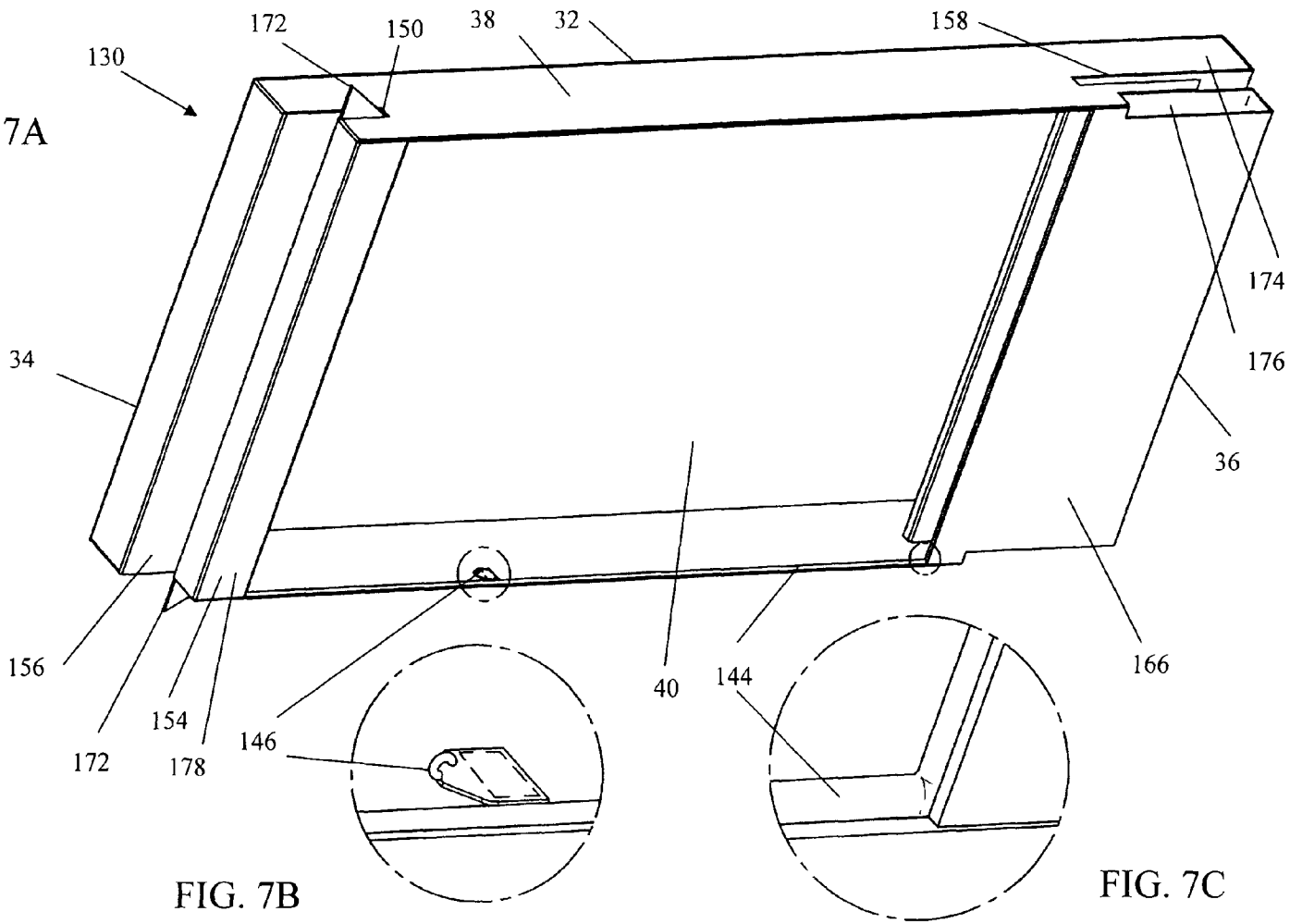
FIG. 7A depicts a bottom perspective view of a second embodiment of a mattress and bed deck cover.
FIG. 7B depicts a detail view of FIG. 7A, focusing on a hook.
FIG. 7C depicts a detail view of FIG. 7A, focusing on an elastic band.
Figure 8:
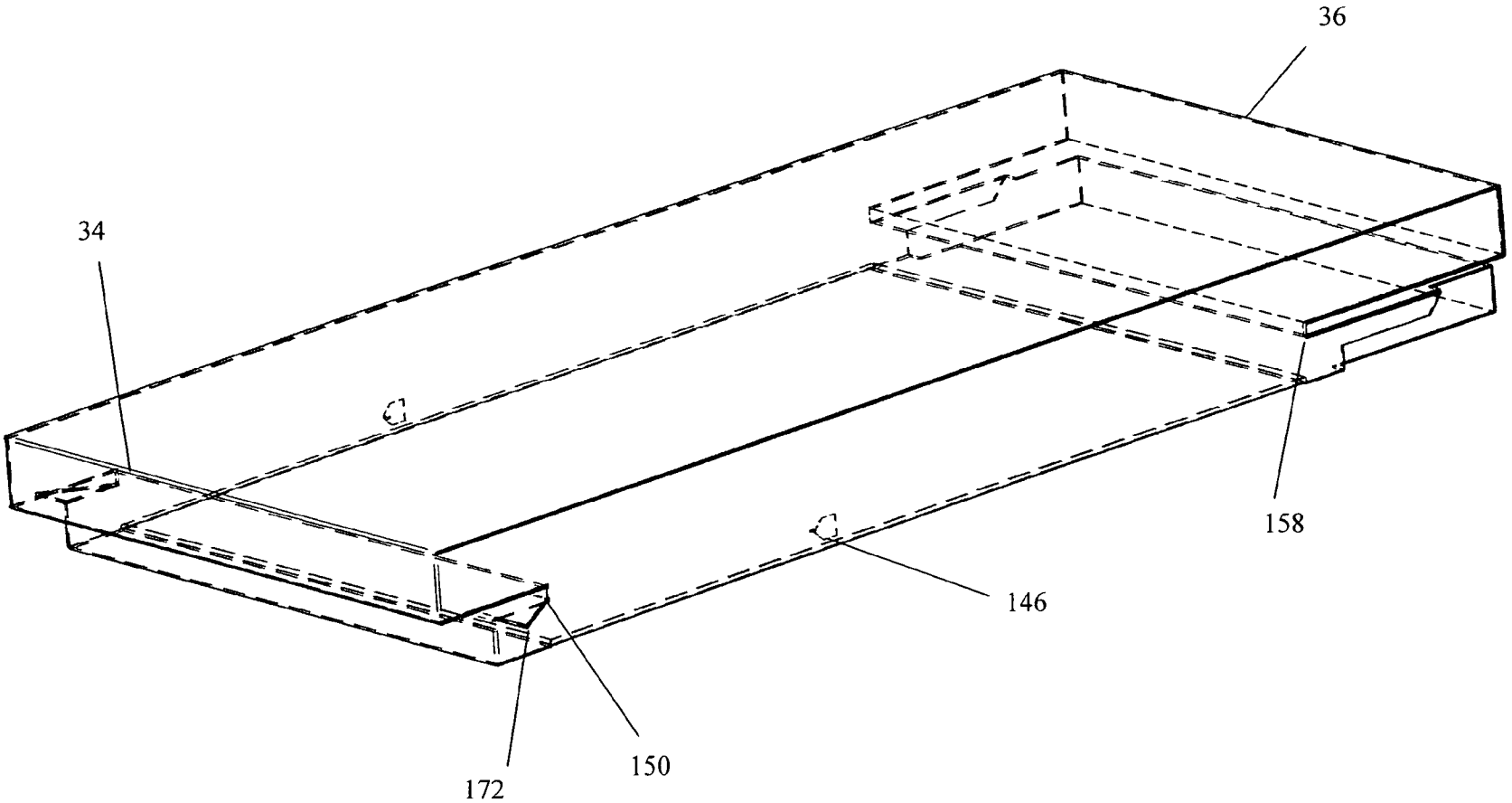
FIG. 8 depicts a hidden line head end perspective view of the second embodiment of a mattress and bed deck cover.

FIGS. 7-8 depict a second embodiment of a mattress and bed deck cover 130. As shown in FIGS. 7A and 8, the mattress and bed deck cover 130 includes a top surface 32, a head end 34 descending from the top surface 32, a foot end 36 descending from the top surface 32 and opposing the head end 34, and a pair of opposing sides 38 descending from the top surface 32 and substantially perpendicular to the head end 34 and the foot end 36 and connected thereto. The cover 130 is preferably constructed from the same liquid-impermeable, stretchable fabric as the first embodiment.

The mattress and bed deck cover 130 includes means for removably fixing the cover 130 in relation to the mattress 10 and bed deck 20. In one embodiment, the means for removably fixing the cover 30 includes at least one elastic band 144. In the second embodiment depicted in FIGS. 7-8, the mattress and bed deck cover 30 includes an elastic band 144 that draws the mattress and bed deck cover 30 under the bed deck 20 for retention. In this embodiment, the elastic band 144 is sewn or welded into the lower edge of the sides 38, the lip of the head end bed deck pocket 154, and the lip of the foot end bed deck pocket 176, defining an opening into which the mattress 10 and bed deck 20 may be serially inserted. The means for removably fixing the cover 130 further comprises a plurality of hooks 146. The plurality of hooks 146 may be attached by sewing or welding directly to inner surface 40 of the cover 130, or by other suitable means.

The cover 130 includes a foot end channel 158. As shown in FIG. 7A, the cover 130 includes a foot end mattress pocket 174 defined by the top surface 32, sides 38, foot end 36, and upper surface of the foot end channel 158. The foot end pocket is sized to receive the foot end of the mattress 10. The cover 130 further comprises a foot end bed deck pocket 176 defined by the lower surface of the foot end channel 158, the sides 38, the foot end 36, and a foot end panel 166 extending the width of the foot end 36 and a portion of the length of the sides 38. The foot end panel 166 is substantially perpendicular to the sides 38 and foot end 36, and is connected thereto, and is substantially parallel to the top surface 32. The foot end bed deck pocket 176 is sized to receive the foot end of the bed deck 20. The sides 38 of the cover 130 descending from the foot end channel 158 narrow to correspond to the shape of a narrowing bed deck (not shown).

The mattress and bed deck cover 130 includes a head end channel 150 located at the head end 34 of the cover 30 and extending the width of the head end 34 and a portion of the length of the sides 38. The head end channel 150 permits a fitted sheet to wrap around the head end corners of the mattress 10 while still limiting contact between contaminants and the mattress 10 and bed deck 20. In this second embodiment, the cover 130 includes a head end mattress pocket 156 defined by the top surface 32, sides 38, head end 34, and upper surface of the head end channel 150. The head end mattress pocket 156 is sized to receive the head end of the mattress 10. The cover 130 further comprises a head end bed deck pocket 154 defined by the lower surface of the head end channel 50, the sides 38, the head end 34, and a head end panel 178 extending the width of the head end 34 and a portion of the length of the sides 38. The head end panel 178 is substantially perpendicular to the sides 38 and head end 34, and is connected thereto, and is substantially parallel to the top surface 32. The head end bed deck pocket 154 is sized to receive the head end of the bed deck 20. The length of the head end bed deck pocket 154 is less than that of the head end mattress pocket 156, corresponding to relative lengths of the mattress 10 and bed deck 20 in this second embodiment.

The cover 130 includes a pair of generally triangular shaped flaps 172 extending laterally from the sides of the head end channel 150. The flaps 172 are configured to cover corners of the bed deck 20 adjacent the head end 34 (not shown), and prevent contaminants from contacting this portion of the bed deck 20.

In the second embodiment, the mattress 10 is sized about 35.0 inches (88.9 cm) wide by about 83.0 inches (210.8 cm) long. The bed deck 20 is about 76 inches (193 cm) inches long. The bed deck 20 is about 35.0 inches (88.9 cm) wide for the majority of its length, and narrows to 34.0 inches (86.4 cm) wide over the 12.5 inches (31.75 cm) of length adjacent the foot end 36. In this embodiment, the mattress and bed deck cover 130 is sized to snugly fit the mattress 10 and bed deck 20. The mattress and bed deck cover 130 is about 83.0 inches (210.8 cm) long, 35.0 inches (88.9 cm) wide and 7.875 inches (20.0 cm) high.

In this second embodiment the head end channel 150 has a length of about 6.5 inches (16.5 cm) and is located at a height of about 4.625 inches (11.75 cm) from the top surface 32 of the cover 130. The head end mattress pocket 156 extends about 7.0 inches (17.8 cm) in length past the end of the head end bed deck pocket 154. The foot end channel 158 has a length of about 15 inches (38.1 cm) and is located at a height of about 4.5 inches (11.4 cm) from the top surface 32 of the cover 130. The channels 150, 158 extend the full width of the cover 130. The foot end bed deck pocket 176 is about 34.0 inches (86.4 cm) wide at the foot end 36, extends in the direction of the head end 34 for about 12.5 inches (31.75 cm), and widens to 35.0 inches (88.9 cm) wide. A generally triangular flap 172 extends from each side of the head end channel 150 and each is about 3.76 inches (9.55 cm) long and about 2.5 inches (6.35 cm) wide.

In a preferred embodiment, the mattress and bed deck cover 30, 130 is capable of being laundered using healthcare laundering techniques. The cover 30, 130 is manufactured primarily using fabric welds. In present invention, 0.125 inch (0.318 cm) fabric welds are used with a pull strength of about 19.8 pounds per square inch (6.895 kPa), which are capable of withstanding the agitation and high temperature of the laundering process. In addition, the hemmed edges surrounding the elastic band 44, 144 may incorporate a plurality of exit holes (not shown) approximately 0.125 inches (0.318 cm) in diameter. The exit holes permit trapped water to drain out during the laundering process. The hemmed edges surrounding the elastic bands 44, 144 are preferably the only hemmed attachments on the cover; all others are welded. The clips 52 are permanently attached to the cover 30 and are not removed prior to laundering.

While the present invention is discussed primarily in context of a hospital setting, the mattress and bed deck cover 30, 130 may be used in non-hospital settings, or with non-adjustable beds. For example, the present invention may be used in nursing homes or hospice facilities. The present invention may also be used in the home, for example, for an individual who uses a hospital-style bed 18 on account of an ongoing medical condition that would benefit from an antimicrobial sleeping surface which prevents contamination of underlying bedding.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A mattress and bed deck cover, said cover comprising:

a top surface;

a head end descending from said top surface;

a foot end descending from said top surface and opposing said head end;

a pair of opposing sides descending from said top surface and substantially perpendicular to said head end and said foot end and connected thereto;

means for removably fixing said cover in relation to a mattress and a bed deck;

a foot end channel extending the width of said foot end and a portion of the length of said sides; and at least one strap descending from at least one of said pair of opposing sides and removably attachable to said bed deck;

wherein said cover is sized to enclose said mattress and at least a portion of said bed deck, with said foot end channel oriented to interpose a portion of said mattress and said bed deck;

wherein each of said at least one strap includes a strap channel and a strap aperture; and wherein said cover further comprises a clip, a portion of said clip retained within said strap channel and a portion of said clip extending through said strap aperture said clip including:

a generally rectangular body having opposing ends;

a pair of arms ascending from said body;

a pair of legs, each of said pair of legs descending from one of said ends, and each of said pair of legs having a nub extending therefrom;

a pair of juts descending from said body, each of said juts located in proximity to one of said pair of legs and configured to oppose said nubs;

wherein said juts, said legs, and said nubs are configured to contact and cooperatively secure said clip to said bed deck;

wherein a portion of said body is retained within said strap channel; and wherein a portion of said pair of arms extend through said strap aperture in a direction extending from said bed.

2. The mattress and bed deck cover of claim 1, said foot end channel, said sides, said top surface, and said foot end defining a foot end mattress pocket sized to receive a portion of said mattress.

3. The mattress and bed deck cover of claim 1, further comprising a foot end panel extending the width of said foot end and a portion of the length of said sides, said foot end panel substantially perpendicular to said sides and said foot end, said foot end panel connected to said sides and said foot end, and said foot end panel substantially parallel to said top surface.

4. The mattress and bed deck cover of claim 1, further comprising a head end panel extending the width of said head end and a portion of the length of said sides, said head end panel substantially perpendicular to said sides and said head end, said head end panel connected to said sides and said head end, and said head end panel substantially parallel to said top surface.

5. The mattress and bed deck cover of claim 4, further comprising a head end pocket configured to accept a portion of at least one of said mattress and said bed deck.

6. The mattress and bed deck cover of claim 1, further comprising a head end channel extending the width of said head end and a portion of the length of said sides.

7. The mattress and bed deck cover of claim 1, further comprising at least one flap extending from said cover.

8. The mattress and bed deck cover of claim 7, wherein said at least one flap is a pair of flaps, each descending from corners of said cover adjacent said foot end, said pair of flaps configured to cover portions of said bed deck.

9. The mattress and bed deck cover of claim 1, further comprising a tab extending from said cover.

10. The mattress and bed deck cover of claim 9, wherein said bed deck includes at least one bed deck guide, and wherein said tab includes at least one tab aperture, each tab aperture configured to receive a bed deck guide to secure and retain said cover on said bed deck.

11. The mattress and bed deck cover of claim 1, said cover further comprising at least one cover aperture.

12. The mattress and bed deck cover of claim 1, wherein said cover is constructed of a liquid-impermeable, multi-directional stretch fabric.

13. The mattress and bed deck cover of claim 1, wherein said cover includes a substantially nonleaching antimicrobial film coating.

14. The mattress and bed deck cover of claim 1, wherein said cover includes a film coating incorporating an antimicrobial agent.

15. The mattress and bed deck cover of claim 14, wherein said agent is antimicrobial metal.

16. The mattress and bed deck cover of claim 15, wherein said antimicrobial metal is silver ions contained within glass carriers.

17. The mattress and bed deck cover of claim 1, wherein said cover is capable of being laundered.

18. The mattress and bed deck cover of claim 1, further comprising a elastic band attached to said sides for drawing said cover beneath said bed deck for retention.

19. The mattress and bed deck cover of claim 1, further comprising at least one hook for removably attaching said cover to said bed deck.

* * * * *